US007013649B2

(12) United States Patent
Monty

(10) Patent No.: US 7,013,649 B2
(45) Date of Patent: Mar. 21, 2006

(54) GAS TURBINE ENGINE COMBUSTOR MIXER

(75) Inventor: Joseph Douglas Monty, Boxford, MA (US)

(73) Assignee: General Electric Company, Schenectady, NY (US)

( * ) Notice: Subject to any disclaimer, the term of this patent is extended or adjusted under 35 U.S.C. 154(b) by 158 days.

(21) Appl. No.: 10/853,091

(22) Filed: May 25, 2004

(65) Prior Publication Data

US 2005/0262843 A1 Dec. 1, 2005

(51) Int. Cl.
*F02C 7/22* (2006.01)
*F02K 3/14* (2006.01)

(52) U.S. Cl. ..... 60/748

(58) Field of Classification Search ..... 60/748
See application file for complete search history.

(56) References Cited

U.S. PATENT DOCUMENTS 3,946,552 A * 3/1976 Weinstein et al. ..... 60/748
4,198,815 A * 4/1980 Bobo et al. ..... 60/748
4,584,834 A 4/1986 Koshoffer et al.
5,123,248 A 6/1992 Monty et al.
5,408,830 A * 4/1995 Lovett ..... 60/737
5,623,827 A 4/1997 Monty
5,833,141 A 11/1998 Bechtel, II et al.
5,916,142 A 6/1999 Snyder et al.
5,941,075 A * 8/1999 Ansart et al. ..... 60/748
6,035,645 A * 3/2000 Bensaadi et al. ..... 60/748
6,279,323 B1 8/2001 Monty et al.
6,453,671 B1 9/2002 Leen et al.
6,460,340 B1 10/2002 Chauvette et al.
6,571,559 B1 6/2003 Fortuna et al.
6,609,377 B1 * 8/2003 Durbin et al. ..... 60/748
6,834,505 B1 * 12/2004 Al-Roub et al. ..... 60/748
6,863,228 B1 * 3/2005 Mao et al. ..... 60/748
6,880,340 B1 * 4/2005 Saitoh ..... 60/748

* cited by examiner

*Primary Examiner*—Ted Kim
(74) *Attorney, Agent, or Firm*—William Scott Andes; Steven J. Rosen

(57) ABSTRACT

A gas turbine engine combustor fuel-air mixer includes a body having a substantially annular venturi and a longitudinal axis therethrough, an upstream end, a downstream end, and an inner surface. A primary radial jet swirler upstream of the venturi includes a plurality of radially extending primary air jets circumferentially and downstream angled with respect to the longitudinal axis. A plurality of axial jets axially extend through the primary swirler air and are circumferentially disposed around the longitudinal axis. An exemplary embodiment of the fuel-air mixer further includes the axial jets and the inner surface of a throat of the venturi being radially located at a radius from the longitudinal axis. The axial jets are located in an insert mounted to an upstream portion of the primary radial jet swirler and axially forward of the plurality of radially extending primary air jets. At least some of the axial jets have jet centerlines that intersect primary swirler centerlines of corresponding ones of the primary air jets downstream of outlets of the primary air jets.

46 Claims, 5 Drawing Sheets

GAS TURBINE ENGINE COMBUSTOR MIXER

BACKGROUND OF THE INVENTION

1. Field of the Invention

This invention relates to fuel-air mixers for gas turbine engine combustors and, more particularly, to reducing the formation of solid carbon or coke on such fuel-air mixers.

2. Description of Related Art

Gas turbine engine combustors use fuel nozzles and fuel-air mixers for mixing and burning fuel with compressed air. The fuel is typically premixed with air in the fuel-air mixers prior to combustion in order to minimize smoke and other undesirable by-products and to maximize the efficiency of the combustion process.

Fuel-air mixers are designed to atomize the fuel and to premix it with air in order to produce efficient and complete combustion. Low pressure fuel-air mixers have been designed which incorporate primary and secondary counter-rotational air swirlers which atomize fuel by the high shear forces developed in the area or zone of interaction between counter-rotating air flows produced by the primary and secondary air swirlers. An air swirler, also referred to as a swirler cup, includes a venturi and circumferentially and downstream angled air jets formed around an axis of the venturi. The air jets swirl the air prior to intermixing with the fuel to enhance atomization as well as mixing.

A very common problem with fuel-air mixers is the formation of carbon, commonly referred to as coking on combustor parts and, in particular, venturis of the air swirlers. Solid carbon or coke is formed by impingement of liquid hydrocarbon fuel on hot metal surfaces. This results in thermal decomposition of the fuel and precipitation of solid carbon or coke on the surface. Coke is typically formed at temperatures between 400 and 900 degrees F., which is typical of the combustor inlet conditions of a modern gas turboshaft or turbofan engine. Solid carbon will oxidize or burn away at temperatures in excess of 900 degrees F.

Although these temperatures are seen during high power operation, the cooling effect of the liquid fuel impingement prevents the venturi surface from reaching temperatures high enough to allow the carbon to burn away. Tests on instrumented venturis have shown surface temperatures to be 300 to 400 degrees F. below the inlet air temperature, which results in the venturi surface being in the 400–900 degrees F. carbon formation window for most of the engine operation. The impingement of liquid fuel also prevents oxygen from reaching the surface, further contributing to carbon buildup.

The formation of carbon on the venturi surface distorts the aerodynamic shape of the surface thereby disrupting the distribution of fuel in the combustor. This results in combustor hot streaks and resulting turbine distress. The combustor temperature distortions also distort the exit temperature thermocouple readings used to monitor engine deterioration, resulting in false deterioration indications. Engine starting and altitude ignition have also been shown to be adversely affected. In severe cases, these carbon deposits have caused total blocking of the venturi passage causing fuel to be deposited outside the combustor liner, and causing casing burn-through and in flight shutdown.

Disclosed in U.S. Pat. No. 6,571,559 is a fuel nozzle positioned inside the upstream end of a radial inflow primary swirler and adjacent to the venturi, a fuel passage through the fuel nozzle from which fuel is sprayed into the venturi at a designated spray angle and, a purge airflow circumscribing the fuel passage. The purge airflow flowing substantially parallel to a longitudinal axis of the venturi to provide a boundary layer of air along the inner surface of the venturi. The boundary layer of air minimizes the amount of fuel contacting the inner surface of the venturi subsequently reducing carbon formation. Annular passages or air shrouds have been incorporated into the fuel injector tip of the fuel nozzle to admit non-swirling air for the purpose of suppressing carbon formation (see U.S. Pat. Nos. 6,571,559 and 5,123,248 as examples). The air shrouds in the fuel nozzle tips cannot always be accommodated in the fuel nozzle tips.

SUMMARY OF THE INVENTION

A gas turbine engine combustor fuel-air mixer includes a body having a substantially annular venturi positioned therein. The venturi having a longitudinal axis therethrough, an upstream end, a downstream end, and an inner surface. A primary radial jet swirler upstream of the venturi includes a plurality of radially extending primary air jets circumferentially and downstream angled with respect to the longitudinal axis. A plurality of axial jets axially extend through the primary swirler air and are circumferentially disposed around the longitudinal axis. The axial jets may have rectangular cross-sections.

An exemplary embodiment of the fuel-air mixer further includes the axial jets and the inner surface of a throat of the venturi being both radially located at about equal distances from the longitudinal axis at a radius as measured from the longitudinal axis. The axial jets are located in an insert mounted to an upstream portion of the primary radial jet swirler and axially forward of the plurality of radially extending primary air jets. The primary radial jet swirler includes a generally annular upstream portion and a conical downstream portion, the plurality of radially extending primary air jets are disposed through the conical downstream portion, and the axial jets are disposed through the upstream portion.

A secondary air swirler is located downstream of the primary radial jet swirler and circumferentially disposed about and radially spaced apart from the venturi. The secondary air swirler includes a plurality of secondary swirler vanes disposed between the venturi and a spaced apart bellmouth-shaped fairing. At least some of the axial jets have jet centerlines that intersect primary swirler centerlines of corresponding ones of the primary air jets downstream of outlets of the primary air jets.

A fuel injector assembly incorporating the gas turbine engine combustor fuel-air mixer includes a fuel nozzle disposed in the annular upstream end of the primary radial jet swirler in alignment with the longitudinal axis.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
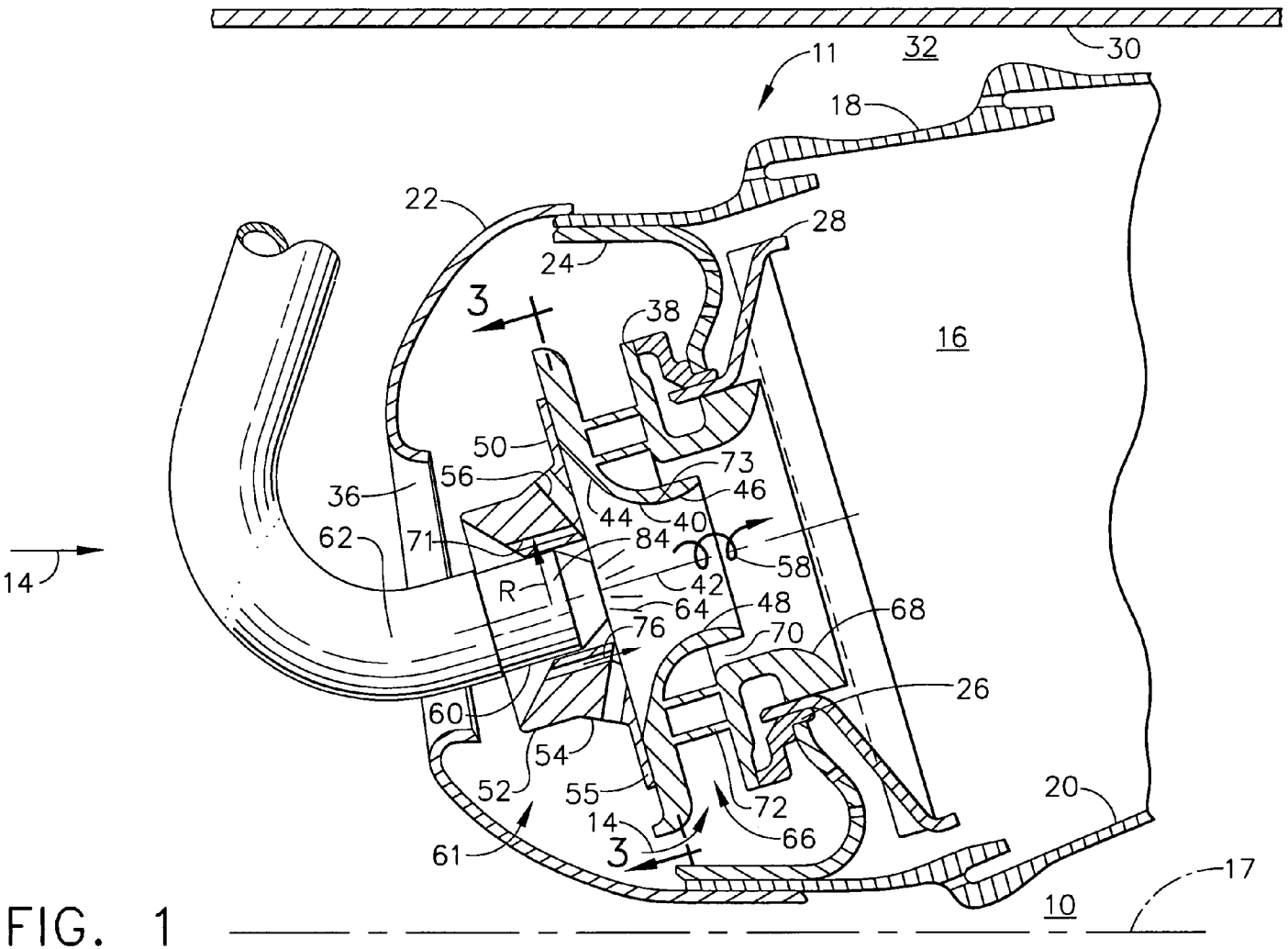
FIG. 1 is a longitudinal sectional view illustration through a portion of an annular combustor having an carburetor with a mixer including a primary radial jet swirler, a secondary radial inflow swirler, and axial jets oriented parallel to the fuel injector tip centerline.

Illustrated in FIG. 1 is an exemplary gas turbine engine combustion section 10 downstream of a compressor diffuser (not illustrated) and in fluid communication with compressor discharge air 14. The combustion section 10 includes a combustor 11 having a combustion chamber 16 therein. The combustor 11 is generally annular in form circumscribing an axially extending engine centerline axis 17. The combustor 11 includes radially outer and inner liners 18 and 20, respectively, and a generally dome-shaped end 22. A combustor bulkhead 24, attached to the outer and inner liners 18 and 20, includes a plurality of circumferentially spaced openings 26, each having disposed therein a gas turbine engine combustor fuel-air mixer 28 for the delivery of fuel and air into the combustion chamber 16.

The combustor 11 is enclosed by a casing 30 which together with the outer liner 18 defines an annular outer passage 32. The dome-shaped end 22 includes a plurality of apertures 36 for supplying compressor discharge air 14 to the fuel-air mixers 28. Each fuel-air mixer 28 includes a body 38 having a substantially annular venturi 40 positioned therein. The venturi 40 has a longitudinal axis 42 therethrough and includes an upstream end 44, a downstream end 46, and an inner surface 48. The upstream end 44 of the venturi abuts a primary radial jet swirler 50. The primary radial jet swirler 50 is illustrated as a tubular ferrule defined by a generally annular upstream portion 52 and a conical downstream portion 54 terminating at a radial flange 55. A plurality of radially extending primary air jets 56 are disposed through the conical downstream portion 54. The primary air jets 56 are circumferentially and downstream angled with respect to the longitudinal axis 42 so that compressor discharge air 14 entering the primary air jets 56 is swirled to produce primary swirler jet airflow 58. The venturi 40 is positioned with respect to the primary radial jet swirler 50 to enable the primary swirler jet airflow 58 to enter the venturi 40 in a swirling manner.

A fuel nozzle 60 is disposed in the annular upstream end 44 of the primary radial jet swirler 50 in alignment with the longitudinal axis 42 of the venturi 40 to provide a fuel injector assembly 61. The fuel nozzle 60 includes a fuel passage 62 for spraying fuel 64 into the venturi 40 where it is atomized and mixed with the primary swirler air. A secondary air swirler 66 downstream of the primary radial jet swirler 50 is circumferentially disposed about and radially spaced apart from the venturi 40. Compressor discharge air 14 flows into the secondary air swirler 66 and is directed by a plurality of secondary swirler vanes 72 disposed between the venturi 40 and a spaced apart bellmouth-shaped fairing 68 and substantially equidistant from one and the other angled to induce a swirl on the flowing compressor discharge air. The secondary swirler vanes may be angled in the same or different tangential direction as the primary swirler air jets 56. The fairing 68 extends aft of the venturi's downstream end 46. The fairing 68 is positioned and spaced so as to, in combination with the venturi 40, form a fluid passageway 70 through which secondary swirler air flows. This secondary swirler air intermixes with the primary swirler jet airflow 58 and fuel 64 mixture aft of the downstream end 46 of the venturi 40, thereby, further atomizing and mixing the fuel and air for combustion. The fuel-air mixer arrangement described typically operates at temperatures approaching 1000 degrees F. The centrifugal effect of the fuel intermixing with the primary swirler jet airflow in the venturi 40 results in fuel wetting the inner surface 48 of the venturi 40 which lowers the surface temperature and, under certain conditions, initiates predominately carbon formation and, in some cases, coke formation, commonly referred to as carboning.

Figure 2:
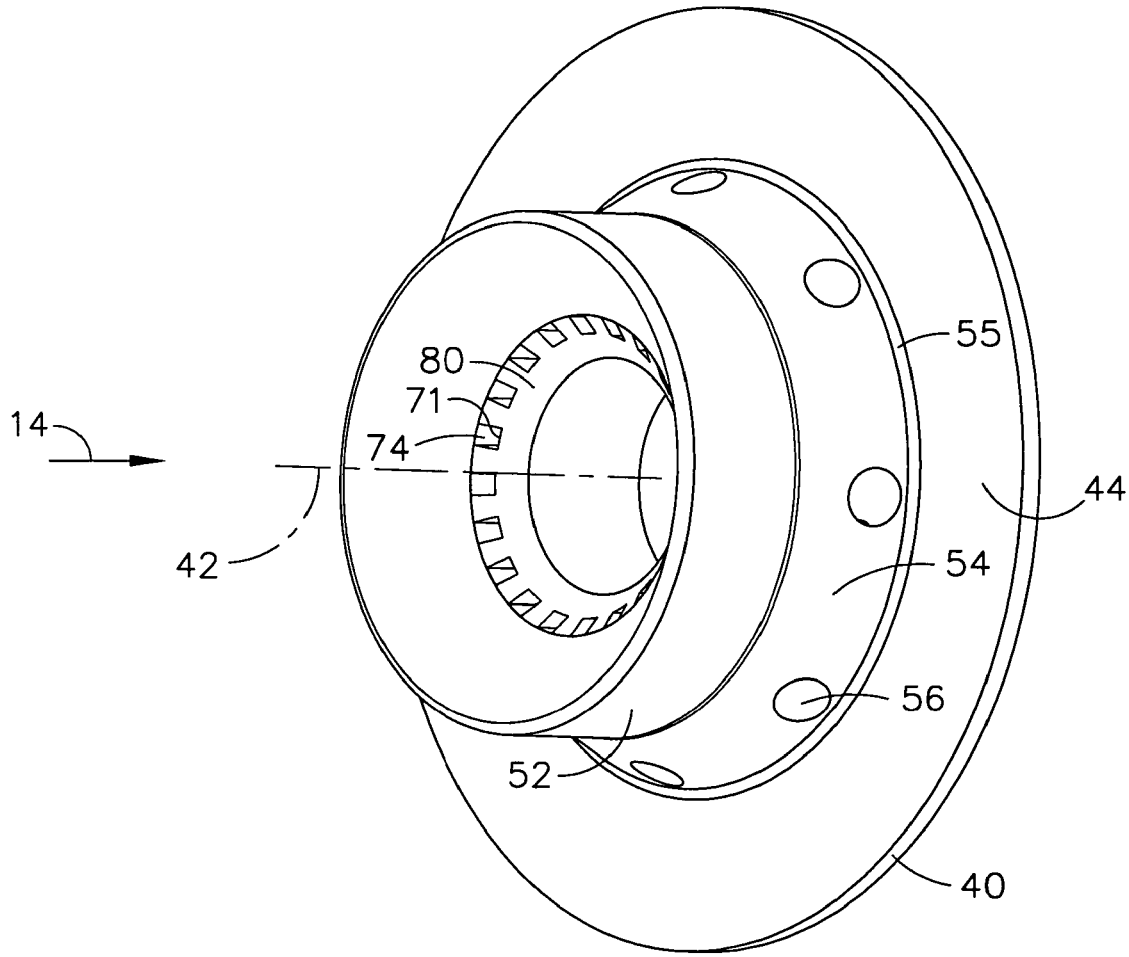
FIG. 2 is a perspective forward looking aft view illustration of the primary radial jet swirler and the axial jets illustrated in FIG. 1.
Figure 3:
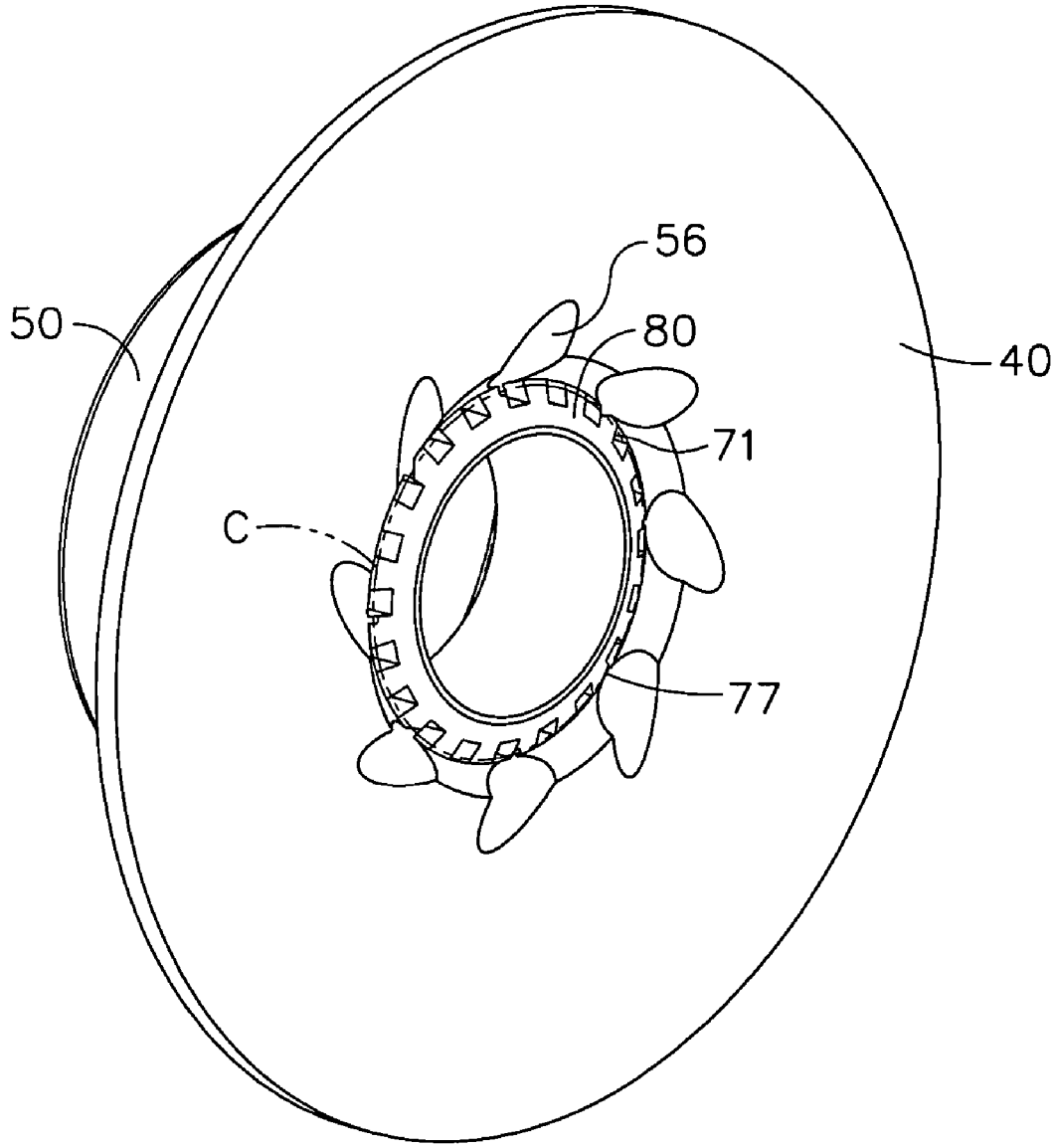
FIG. 3 is a perspective aft looking forward view illustration of the primary radial jet swirler and the axial jets through 3—3 in FIG. 1.

Referring to FIGS. 1, 2, and 3, a plurality of axial jets 71 axially extending through the primary swirler air are circumferentially disposed around the fuel nozzle 60 and the longitudinal axis 42 and are open to the compressor discharge air 14 flowing through the fuel-air mixer 28 in the axial direction. The axial jets 71 are used to form a boundary layer of air on the inner surface 48 of the venturi 40 to minimize the amount of fuel contacting the surface and subsequently reduce carboning. This portion of axially flowing compressor discharge air 14 is referred to as purge airflow 76. The axial jets 71 are illustrated herein as having rectangular cross-sections 74 or, more specifically, square cross-sections. The axial jets 71 may have cross-sections with other shapes such as circular, elliptical, or racetrack cross-sections. Note that the axial jets 71 are located at a radius R as measured from the longitudinal axis 42 which is about the same distance as the inner surface 48 of a throat 73 of the venturi 40. Both the axial jets 71 and the inner surface 48 of the throat 73 are located substantially at the radius R as measured from the longitudinal axis 42. Placement of the axial jets at a radius roughly that of the venturi throat provides the required isolation of the fuel spray from the venturi wall, while still allowing entrainment of the fuel spray into the primary swirl flow.

Figure 4:
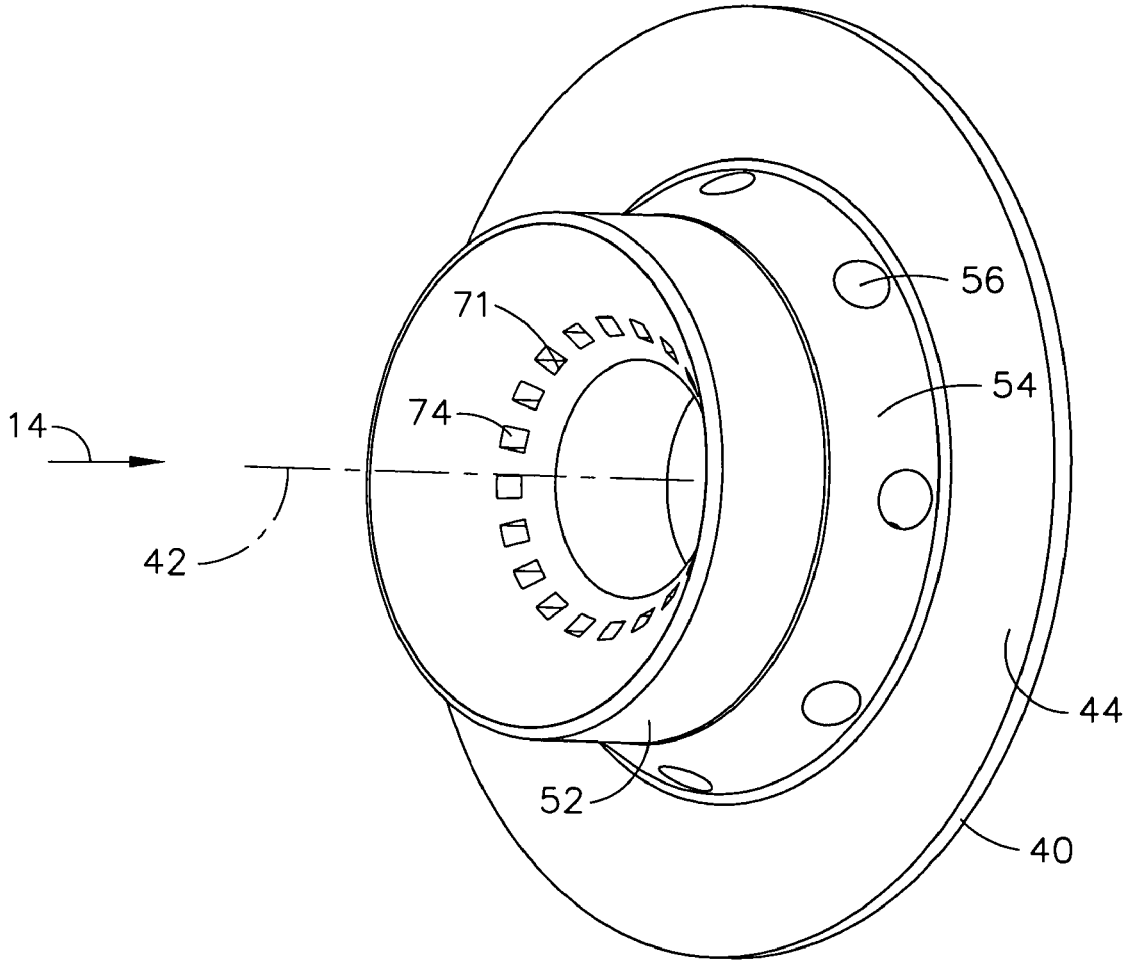
FIG. 4 is a perspective forward looking aft view illustration of an alternative primary radial jet swirler and the axial jets illustrated in FIG. 1.

In FIGS. 2 and 3, the axial jets 71 are illustrated as axially extending through an insert 80 mounted to the upstream portion 52 and radially located between the fuel nozzle 60 and the upstream portion 52 of the primary radial jet swirler 50. The insert 80 is also located upstream or axially forward of the plurality of radially extending primary air jets 56. The insert 80 is welded or otherwise attached or bonded to the upstream portion 52 of the primary radial jet swirler 50 such that a tip 84 of the fuel nozzle 60 may be inserted within the insert. Alternatively, as illustrated in FIG. 4, the insert 80 may be eliminated from the fuel injector assembly 61 and the axial jets 71 axially extend through the upstream portion 52 of the primary radial jet swirler 50 and upstream or axially forward of the plurality of radially extending primary air jets 56.

Figure 5:
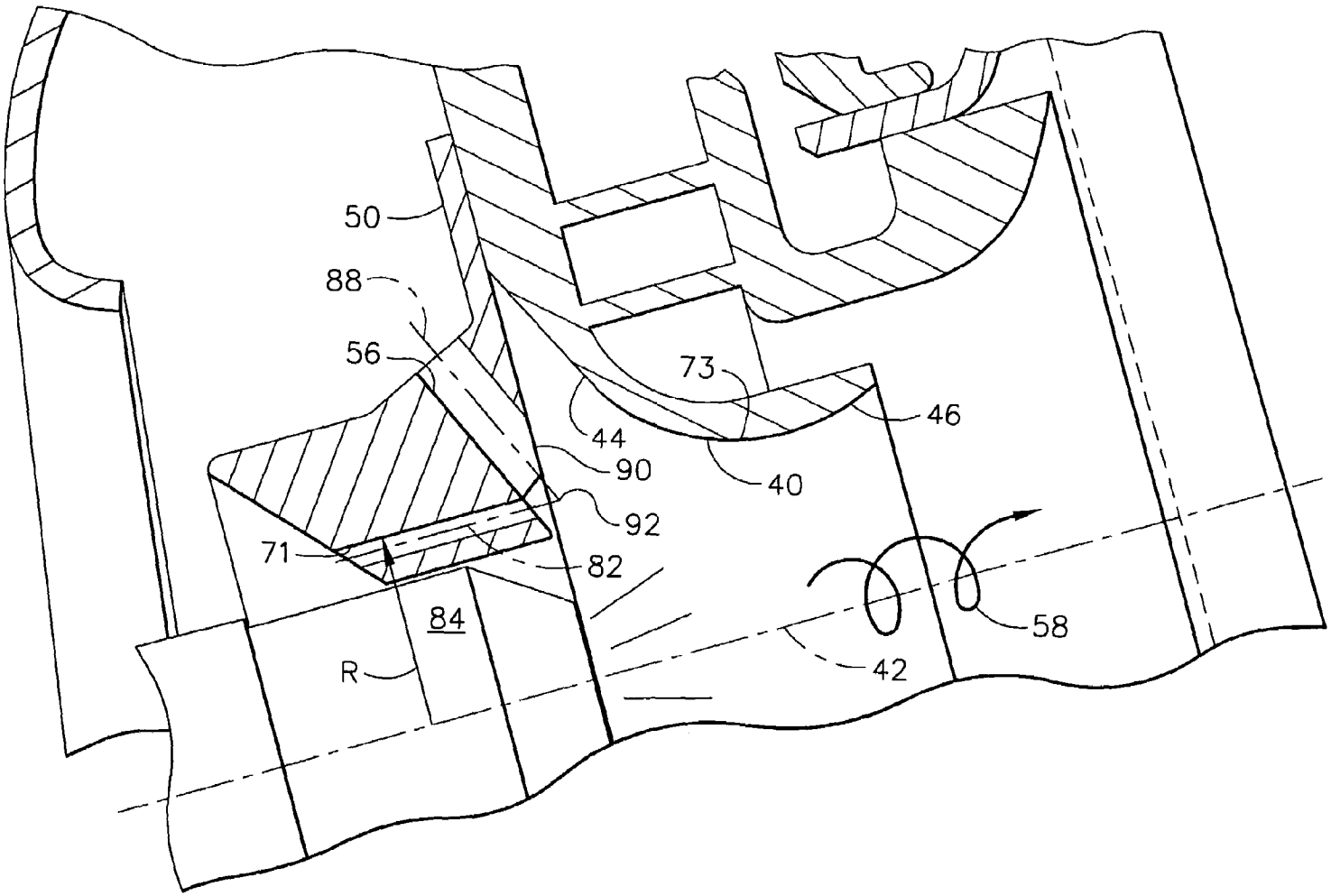
FIG. 5 is an enlarged longitudinal sectional view illustration of the primary radial jet swirler and the axial jets illustrated in FIG. 1.

At least some of the axial jets 71 extend axially through the primary radial jet swirler 50 into some of the primary air jets 56 are radially located inwardly of a circumference C of the primary radial jet swirler 50 defined by radially inwardmost points 77 of the primary air jets 56. These axial jets 71 have jet centerlines 82 that intersect primary swirler centerlines 88 of corresponding ones of the primary air jets 56 at an intersection point 92 downstream of discharges or outlets 90 of the primary air jets 56 as illustrated in FIG. 5.

Prior art fuel-air mixer designs delivered purge airflow to the fuel-air mixer using a shroud defined by an annular air passage in the fuel nozzle as disclosed and illustrated in U.S. Pat. No. 6,571,559. This is not practical on an smaller gas turbine engines, smaller than a GE CF6 for example, when using a dual passage fuel injector. Also fuel injector heat shielding is seriously compromised by placing the air shroud on the injector. Putting the purge on the swirler allows much more flexibility in fuel injector design as is done in the present invention.

The present invention has been described in an illustrative manner. It is to be understood that the terminology which has been used is intended to be in the nature of words of description rather than of limitation. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A gas turbine engine combustor fuel-air mixer comprising:

a body having a substantially annular venturi positioned therein, the venturi having a longitudinal axis therethrough and an upstream end, a downstream end, and an inner surface, a primary radial jet swirler upstream of the venturi, the primary radial jet swirler including a plurality of radially extending primary air jets circumferentially and downstream angled with respect to the longitudinal axis, and a plurality of axial jets axially extending through the primary swirler air and circumferentially disposed around the longitudinal axis.

2. A fuel-air mixer as claimed in claim 1, further comprising the axial jets and the inner surface of a throat of the venturi being radially located at about equal distances from the longitudinal axis at a radius as measured from the longitudinal axis.

3. A fuel-air mixer as claimed in claim 1, further comprising the axial jets having rectangular cross-sections.

4. A fuel-air mixer as claimed in claim 1, further comprising the axial jets located in an insert mounted to an upstream portion of the primary radial jet swirler and axially forward of the plurality of radially extending primary air jets.

5. A fuel-air mixer as claimed in claim 4, further comprising the axial jets and the inner surface of a throat of the venturi being radially located at about equal distances from the longitudinal axis at a radius as measured from the longitudinal axis.

6. A fuel-air mixer as claimed in claim 5, further comprising the axial jets having rectangular cross-sections.

7. A fuel-air mixer as claimed in claim 1, further comprising a secondary air swirler downstream of the primary radial jet swirler and circumferentially disposed about and radially spaced apart from the venturi.

8. A fuel-air mixer as claimed in claim 7, further comprising the secondary air swirler having a plurality of secondary swirler vanes disposed between the venturi and a spaced apart bellmouth-shaped fairing.

9. A fuel-air mixer as claimed in claim 8, further comprising the axial jets and the inner surface of a throat of the venturi being radially located at about equal distances from the longitudinal axis at a radius as measured from the longitudinal axis.

10. A fuel-air mixer as claimed in claim 9, further comprising the axial jets having rectangular cross-sections.

11. A fuel-air mixer as claimed in claim 8, further comprising the axial jets located in an insert mounted to an upstream portion of the primary radial jet swirler and axially forward of the plurality of radially extending primary air jets.

12. A fuel-air mixer as claimed in claim 11, further comprising the axial jets and the inner surface of a throat of the venturi being radially located at about equal distances from the longitudinal axis at a radius as measured from the longitudinal axis.

13. A fuel-air mixer as claimed in claim 12, further comprising the axial jets having rectangular cross-sections.

14. A fuel-air mixer as claimed in claim 1, further comprising:

the primary radial jet swirler having a generally annular upstream portion and a conical downstream portion, the plurality of radially extending primary air jets being disposed through the conical downstream portion, and the axial jets being disposed through the upstream portion.

15. A fuel-air mixer as claimed in claim 14, further comprising the axial jets and the inner surface of a throat of the venturi being radially located at about equal distances from the longitudinal axis at a radius as measured from the longitudinal axis.

16. A fuel-air mixer as claimed in claim 15, further comprising the axial jets having rectangular cross-sections.

17. A fuel-air mixer as claimed in claim 14, further comprising a secondary air swirler downstream of the primary radial jet swirler and circumferentially disposed about and radially spaced apart from the venturi.

18. A fuel-air mixer as claimed in claim 17, further comprising the secondary air swirler having a plurality of secondary swirler vanes disposed between the venturi and a spaced apart bellmouth-shaped fairing.

19. A fuel-air mixer as claimed in claim 14, further comprising the axial jets located in an insert mounted to an upstream portion of the primary radial jet swirler and axially forward of the plurality of radially extending primary air jets.

20. A fuel-air mixer as claimed in claim 19, further comprising the axial jets and the inner surface of a throat of the venturi being radially located at about equal distances from the longitudinal axis at a radius as measured from the longitudinal axis.

21. A fuel-air mixer as claimed in claim 20, further comprising the axial jets having rectangular cross-sections.

22. A fuel-air mixer as claimed in claim 14, further comprising at least some of the axial jets having jet centerlines that intersect primary swirler centerlines of corresponding ones of the primary air jets downstream of outlets of the primary air jets.

23. A fuel-air mixer as claimed in claim 22, further comprising the axial jets and the inner surface of a throat of the venturi being radially located at about equal distances from the longitudinal axis at a radius as measured from the longitudinal axis.

24. A fuel-air mixer as claimed in claim 23, further comprising the axial jets having rectangular cross-sections.

25. A fuel-air mixer as claimed in claim 22, further comprising a secondary air swirler downstream of the primary radial jet swirler and circumferentially disposed about and radially spaced apart from the venturi.

26. A fuel-air mixer as claimed in claim 25, further comprising the secondary air swirler having a plurality of secondary swirler vanes disposed between the venturi and a spaced apart bellmouth-shaped fairing.

27. A fuel-air mixer as claimed in claim 22, further comprising the axial jets located in an insert mounted to an upstream portion of the primary radial jet swirler and axially forward of the plurality of radially extending primary air jets.

28. A fuel-air mixer as claimed in claim 27, further comprising the axial jets and the inner surface of a throat of the venturi being radially located at about equal distances from the longitudinal axis at a radius as measured from the longitudinal axis.

29. A fuel-air mixer as claimed in claim 28, further comprising the axial jets having rectangular cross-sections.

30. A fuel injector assembly comprising:

a gas turbine engine combustor fuel-air mixer having a body with a substantially annular venturi positioned within the body, the venturi having a longitudinal axis therethrough and an upstream end, a downstream end, and an inner surface, a primary radial jet swirler upstream of the venturi, a fuel nozzle disposed in the annular upstream end of the primary radial jet swirler in alignment with the longitudinal axis, the primary radial jet swirler including a plurality of radially extending primary air jets circumferentially and downstream angled with respect to the longitudinal axis, and a plurality of axial jets axially extending through the primary swirler air and circumferentially disposed around the longitudinal axis.

31. An assembly as claimed in claim 30, further comprising the axial jets and the inner surface of a throat of the venturi being radially located at about equal distances from the longitudinal axis at a radius as measured from the longitudinal axis.

32. An assembly as claimed in claim 31, further comprising the axial jets having rectangular cross-sections.

33. An assembly as claimed in claim 31, further comprising the axial jets located in an insert radially located between the fuel nozzle and the upstream portion of the primary radial jet swirler and axially forward of the plurality of radially extending primary air jets.

34. An assembly as claimed in claim 33, further comprising the axial jets and the inner surface of a throat of the venturi being radially located at about equal distances at a radius as measured from the longitudinal axis.

35. An assembly as claimed in claim 34, further comprising a secondary air swirler downstream of the primary radial jet swirler and circumferentially disposed about and radially spaced apart from the venturi.

36. An assembly as claimed in claim 35, further comprising the secondary air swirler having a plurality of secondary swirler vanes disposed between the venturi and a spaced apart bellmouth-shaped fairing.

37. An assembly as claimed in claim 36, further comprising the axial jets and the inner surface of a throat of the venturi being radially located at about equal distances at a radius as measured from the longitudinal axis.

38. An assembly as claimed in claim 30, further comprising:

the primary radial jet swirler having a generally annular upstream portion and a conical downstream portion, the plurality of radially extending primary air jets being disposed through the conical downstream portion, and the axial jets being disposed through the upstream portion.

39. An assembly as claimed in claim 38, further comprising the axial jets and the inner surface of a throat of the venturi being radially located at about equal distances at a radius as measured from the longitudinal axis.

40. An assembly as claimed in claim 39, further comprising a secondary air swirler downstream of the primary radial jet swirler and circumferentially disposed about and radially spaced apart from the venturi.

41. An assembly as claimed in claim 40, further comprising the secondary air swirler having a plurality of secondary swirler vanes disposed between the venturi and a spaced apart bellmouth-shaped fairing.

42. An assembly as claimed in claim 38, further comprising the axial jets located in an insert radially located between the fuel nozzle and the upstream portion of the primary radial jet swirler and axially forward of the plurality of radially extending primary air jets.

43. An assembly as claimed in claim 42, further comprising the axial jets and the inner surface of a throat of the venturi being radially located at about equal distances at a radius as measured from the longitudinal axis.

44. An assembly as claimed in claim 43, further comprising a secondary air swirler downstream of the primary radial jet swirler and circumferentially disposed about and radially spaced apart from the venturi.

45. An assembly as claimed in claim 44, further comprising the secondary air swirler having a plurality of secondary swirler vanes disposed between the venturi and a spaced apart bellmouth-shaped fairing.

46. An assembly as claimed in claim 45, further comprising the axial jets and the inner surface of a throat of the venturi being radially located at about equal distances at a radius as measured from the longitudinal axis.

* * * * *